United States Patent [19]

Suzuki et al.

[11] Patent Number: 5,042,408

[45] Date of Patent: Aug. 27, 1991

[54] SEWING MACHINE HAVING THREAD CUTTING MECHANISM AND METHOD FOR MINIMIZING LENGTH OF LEADING END PORTION OF NEEDLE THREAD

[75] Inventors: Hajime Suzuki, Nagoya; Kazuhisa Ito, Aichi, both of Japan

[73] Assignee: Brother Kogyo Kabushiki Kaisha, Aichi, Japan

[21] Appl. No.: 592,309

[22] Filed: Oct. 2, 1990

[30] Foreign Application Priority Data

Oct. 31, 1989 [JP] Japan ..... 1-285662

[51] Int. Cl.[5] ..... D05B 47/04; D05B 65/02

[52] U.S. Cl. ..... 112/292; 112/254; 112/300; 112/262.1

[58] Field of Search ..... 112/292, 291, 293, 296, 112/254, 255, 300, 262.1

[56] References Cited

U.S. PATENT DOCUMENTS

| | | | |
|---|---|---|---|
| 3,728,978 | 4/1973 | Honda et al. | 112/292 |
| 3,747,548 | 7/1973 | Brophy et al. | 112/293 |
| 4,098,208 | 7/1978 | Hedegaard | 112/291 |
| 4,202,286 | 5/1980 | Costas | 112/286 |
| 4,793,273 | 12/1988 | Hara et al. | 112/254 |
| 4,892,048 | 1/1990 | Karuga et al. | 112/254 |
| 4,967,679 | 11/1990 | Hara et al. | 112/255 X |

FOREIGN PATENT DOCUMENTS

| | | |
|---|---|---|
| 56-139793 | 10/1981 | Japan . |
| 61-157487 | 9/1986 | Japan . |

*Primary Examiner*—Peter Nerbun

*Attorney, Agent, or Firm*—Oliff & Berridge

[57] ABSTRACT

A sewing machine provided with a thread cutting mechanism and a needle thread tension release mechanism. Normally, the needle thread is subjected to a proper tension by a thread tension regulating mechanism. However, at an initial start-up period of the sewing operation, the needle thread tension is released by the tension release mechanism for a first predetermined period during which a needle thread loop is trapped by a loop taker. Further, the sewing machine is provided with a thread holding member for holding a leading end portion of the needle thread. The holding member is movable to its thread release position after elapse of a second predetermined period at the initial start-up period of the sewing operation. The first predetermined period is within the second predetermined period.

12 Claims, 13 Drawing Sheets

SEWING MACHINE HAVING THREAD CUTTING MECHANISM AND METHOD FOR MINIMIZING LENGTH OF LEADING END PORTION OF NEEDLE THREAD

BACKGROUND OF THE INVENTION

The present invention relates to a sewing machine provided with a thread cutting unit. More particularly, the present invention relates to the sewing machine in which a minimized or a reduced length of a leading end portion of the needle thread remains on a back side of a workpiece when a new sewing operation is initiated. The present invention also relates to a method for minimizing a length of the leading end portion of the needle thread between an eye of the sewing needle to an exact cutting end point thereof.

According to a conventional sewing machine having a thread cutting unit, a thread drawn from the lastly stitched point of a workpiece or a fabric is required to be cut when the sewing operation is terminated. For cutting the thread, Japanese Patent Application Kokai No. 56-139793 discloses a thread cutting mechanism in which upon completion of the sewing operation, a movable blade is brought into engagement with a stationary blade by driving a rotating hook shaft for automatically cutting the needle thread and a bobbin thread at a position between a throat plate and a shuttle race complete.

In a sewing machine provided with such thread cutting mechanism, if the needle thread length between a needle eye and the exact cutting point is insufficiently short, the needle thread may be easily disengaged from the eye of the needle at a start phase of subsequent or next sewing operation. That is, thread cast-off may occur. Therefore, in the disclosed device, the thread cutting is performed so that sufficient residual thread length can be provided between the needle eye and the exact cutting point in order to retain the thread to be still engaged with the needle eye at the start timing of the subsequent sewing operation.

On the other hand, conventionally, a thread tension regulating mechanism is provided so as to impart a proper tension to the needle thread positioned between a needle thread supply reel and a thread take up lever. The thread tension regulating mechanism, however, performs tension release operation with respect to the needle thread at several timings, such as ascending timing of a pressure foot for installing or removing a workpiece on or from a sewing machine table, and needle thread cutting timing by the movable blade and the stationary blade of the thread cutting mechanism while the movable blade pulls out the needle thread by a predetermined length.

Particularly, in the sewing machine having the thread cutting mechanism, when the thread cutting operation is completed for completion of the sewing operation, the sewing needle is positioned at its uppermost position. However, this timing is slightly earlier than a timing where the needle thread is pulled to the most upward position by the thread take up lever. Therefore, it is necessary to cut the needle thread so as to remain a relatively large length of the needle thread between the eye of the needle and the exact cutting point of the thread. That is, at an initial phase of the next sewing operation, the thread take up lever is slightly moved upwardly, and further, the needle thread loop must be trapped or defined by the shuttle race complete until the needle thread is pressed by the pressure foot through the workpiece feeding. To this effect, a relatively large length of the leading end portion of the needle thread must be required between the eye of the needle and the exact cutting point capable of providing engagements or several knots between the needle thread and the bobbin thread while still avoiding thread cast off or thread disengagement from the eye of the sewing needle.

In this connection, in the conventional sewing machine having the thread cutting mechanism disclosed in the Japanese Patent Application Kokai No. 56-139793, the thread cast off is avoidable at the initial phase of the new sewing operation. However, since excessive length of the leading end portion of the needle thread is provided, as shown in FIG. 15, the leading end portion of the needle thread Ns remains on the back side of a workpiece W by a large length, and the leading end portion may be entangled with the bobbin thread Bs in the subsequent stitchings to form nest-like thread entanglements. As a result, stitching quality may be lowered.

In another aspect, a thread holding device has been proposed in Japanese Patent Application Kokai No. 61-157487 which device avoids the needle thread cast-off from the needle eye at a first stitching, and also avoids entanglement of the needle thread and the bobbin thread at the back surface of the workpiece. In order to attain these objects, the disclosed device is provided with a thread holding unit and a thread trapping member. An end portion of the needle thread cut by a thread cutting mechanism at the terminal phase of the sewing operation is trapped by the thread trapping member at a position above the throat plate, and the trapped cut end portion of the needle thread is held by the thread holding unit in cooperation with the thread trapping member at a position largely spaced away from the sewing needle.

In the conventional thread holding unit, a nest like thread entanglement is avoidable between the needle thread Ns and the bobbin thread Bs at the back surface of the workpiece W. However, in this conventional device, since the needle thread length between the needle eye and the exact cutting end portion is relatively long and the needle thread Ns is held at a position greatly remote from the needle eye, relatively long needle thread may remain on the top surface of the workpiece W as shown in FIG. 16. Therefore, thread pinching may be required in which the leading end portion of the needle thread is manually pinched and cut. This leads to the consumption of the needle thread which is not used for the exact stitching, and even after the pinching, the remaining cut end portion still remains on the front surface of the workpiece.

SUMMARY OF THE INVENTION

To overcome these drawbacks, the present invention has been made to provide a sewing machine provided with a thread cutting mechanism in which a leading end portion of a needle thread can remain on a back surface of a workpiece by a minimized or reduced length in order to avoid entanglement of the leading end portion of the needle thread with a bobbin thread at an initial phase of a next sewing operation.

The object will be attained in accordance with the present invention by providing a sewing machine including a sewing machine motor, a bed portion, a throat plate mounted on the bed portion and formed with a needle hole, a sewing needle driven by the sewing machine motor to be reciprocatable through the needle hole in a vertical direction, a thread take-up lever driven in synchronism with the vertically reciprocating movement of the sewing needle, a loop taker positioned below the throat plate for engaging a needle thread and a bobbin thread with each other in cooperation with the sewing needle, a thread cutting mechanism for cutting the needle thread and the bobbin thread at a position between the throat plate and the loop taker, a thread tension regulating mechanism for applying a resistive force to the needle thread positioned between a thread supplying means and the thread take-up lever, and a thread tension release mechanism for releasing the resistive force from the needle thread, and the improvement comprising; means for generating a sewing machine motor energization signal, and control means for actuating the thread tension release mechanism for a first predetermined period in response to the sewing machine motor energization signal in order to release a tension applied to the needle thread at the thread tension regulating mechanism at an initial start-up period of a sewing operation.

In another aspect of the present invention there is provided a method for minimizing a length of a leading end portion of a needle thread in a sewing machine which includes a sewing machine motor, a bed portion, a throat plate mounted on the bed portion and formed with a needle hole, a sewing needle driven by the sewing machine motor to be reciprocatable through the needle hole in a vertical direction, a thread take up lever driven in synchronism with the vertically reciprocating movement of the sewing needle, a loop taker positioned below the throat plate for engaging a needle thread and a bobbin thread with each other in cooperation with the sewing needle, a thread cutting mechanism for cutting the needle thread and the bobbin thread at a position between the throat plate and the loop taker, a thread tension regulating mechanism for applying a resistive force to the needle thread positioned between a thread supplying means and the thread take-up lever, and a thread tension release mechanism for releasing the resistive force from the needle thread, and the method comprising the steps of: generating a sewing machine motor energization signal, and actuating the thread tension release mechanism for a first predetermined period in response to the sewing machine motor energization signal in order to release a tension applied to the needle thread at the thread tension regulating mechanism at an initial start-up period of a sewing operation.

In one preferred embodiment, the sewing machine further comprises: a holding mechanism for holding a leading end portion of the needle thread, the holding mechanism comprising a thread holding member provided movable to a thread trapping position at a position immediately below the sewing needle positioned at its uppermost position, a thread holdable position at a position closely beside the sewing needle positioned at its uppermost position, and a thread releasable position for releasing the trapped and held needle thread; and a holding force imparting member engageable with the thread holding member when the thread holding member is at its thread holdable position for holding the leading end portion of the needle thread between the thread holding member and the holding force imparting member, drive means connected to the thread holding member for selectively moving the thread holding member to one of its thread trapping position, thread holdable position and thread releasable position, and means for controlling the drive means for moving the thread holding member from its thread releasable position to its thread holdable position by way of its thread trapping position after the thread cutting operation by the thread cutting mechanism is completed and for controlling the drive means for moving the thread holding member to its thread releasable position after elapse of a second predetermined period and in response to the sewing machine motor energization signal. The first predetermined period is within the second predetermined period.

In the sewing machine having the thread cutting mechanism of the present invention, the needle thread and the bobbin thread are automatically cut by the thread cutting mechanism when the sewing operation is completed. Upon completion of the sewing operation, the thread take-up lever does not reach its uppermost position, and therefore, the thread take-up lever is slightly moved upwardly and then moved downwardly at a start phase of the next sewing operation. In this movement of the thread take-up lever, if the tension is applied to the needle thread by the needle thread tension regulating mechanism, the leading end portion of the needle thread (a portion between the eye of the sewing needle and the exactly cut end point of the needle thread) may be pulled toward the thread take-up lever and is disengaged from the eye of the sewing needle (thread cast off may occur) unless sufficient length of the leading end portion remains, since the needle thread is not continuously supplied from a supply source such as a thread reel during the vertical reciprocating motion of the thread take-up lever and during the loop trapping period of the needle thread by the loop taker and the downward movement of the sewing needle.

In accordance with the present invention, however, such disadvantageous thread cast-off can be eliminated by the thread releasing mechanism and thread releasing control means. That is, in response to the sewing machine motor energization signal for starting the next sewing operation after cutting the thread, the thread tension releasing control means actuates the thread tension releasing mechanism for a predetermined period after the energization of the sewing machine motor. During this predetermined period, any tension application to the needle thread by the thread tension regulating mechanism is restrained, and therefore, required length of the needle thread can be supplied to the supply source. Accordingly, any substantial tensile force is not imparted to the needle thread during this period, to thereby avoid thread cast off.

At the time of first stitching, after the sewing needle is moved downwardly, the thread take-up lever is also moved downwardly, and when the loop taker traps a needle thread loop, the leading end portion of the needle thread is subjected to a resistive force only from the workpiece when the needle passes therethrough. Accordingly, the leading end portion is pulled by a hook and is directed toward the back side of the workpiece. In this case, the length of the leading end portion is not substantially changed, and a knot between the needle thread and the bobbin thread at the time of the initial stitching is not formed.

Further, according to one embodiment of the present invention, provided is means for controlling the drive means which drives the needle thread leading end portion holding mechanism. This control means controls the drive means after the deenergization of the sewing machine motor and after the thread cutting operation of the thread cutting mechanism in such a manner that the thread holding member of the thread holding mechanism can be moved from its thread releasing position, through the thread trapping position, to the thread holding position where the thread holding member is positioned immediately beside the sewing needle positioned at its uppermost position. Because of such control, the thread holding member can be moved to its thread holding position with maintaining the trapping state of the leading end portion of the needle thread which leading end portion has been extended through the sewing needle and trapped at the trapping position of the thread holding member. In the thread holding position, in cooperation with the holding force imparting member, the leading end portion of the needle thread is held or clamped between the thread holding member and the holding force imparting member.

Furthermore, the control means for controlling the thread holding device driving means controls the driving means in response to the sewing machine motor energization signal so that the thread holding member can be moved to its thread releasing position after the second predetermined period (t3 in FIG. 11) has been passed. That is, after the sewing machine motor is energized, and after elapse of the second predetermined period during which the sewing needle is moved downwardly from its uppermost position and the needle thread loop is trapped by the loop taker and further the knot is formed between the needle thread and the bobbin thread. On the other hand, the control means for controlling the needle thread tension releasing mechanism operates the thread tension releasing mechanism for the first predetermined period within the second predetermined period in response to the sewing machine motor energization signal so that the needle thread tension is releasable by the thread tension regulating mechanism at the start phase of the sewing operation. The first predetermined period is started after the energization of the sewing machine motor and in the second predetermined period the sewing needle is moved from its uppermost position to its lowermost position, and the needle thread loop, which is provided when the sewing needle begins to move upwardly from its lowermost position for slackening the needle thread, is trapped by the loop taker or a shuttle race complete. (that is, the loop take can enter into a space between the sewing needle and the slackened needle thread for thread trapping.) Therefore, any thread tension which may be applied due to the vertical reciprocating motion of the thread take-up lever and the formation of the needle thread loop may not be applied to the needle thread, to thereby avoid any release of the leading end portion of the needle thread from the thread holding mechanism.

DETAILED DESCRIPTION OF THE PREFERRED EMBODIMENT

A sewing machine according to one embodiment of this invention will be described with reference to accompanying drawings. The sewing machine described herein is provided with a thread cutting mechanism, a thread tension regulating mechanism, a holding mechanism for holding a leading end portion of a needle thread, and a drive mechanism for driving the holding mechanism.

Figure 1:
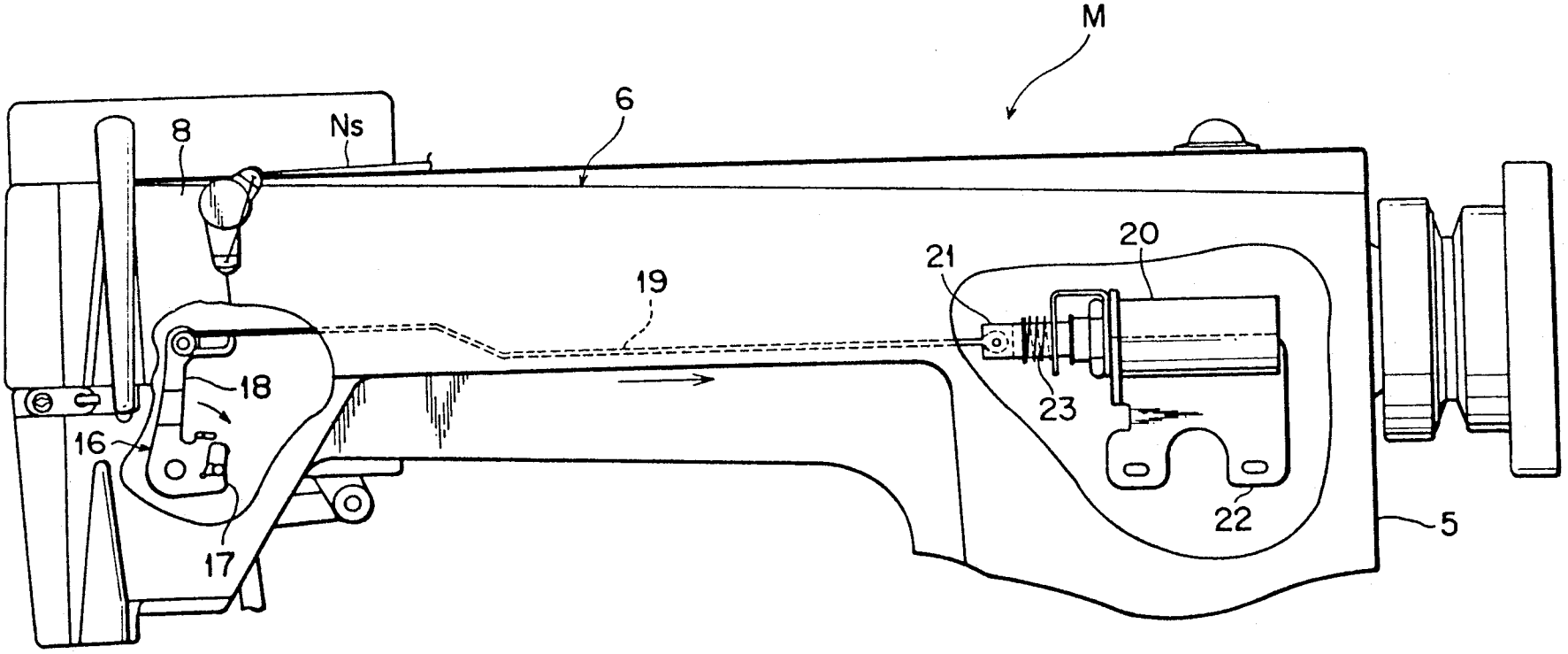
FIG. 1 is a front view partially cut away showing an arm portion of a sewing machine according to one embodiment of the present invention.
Figure 2:
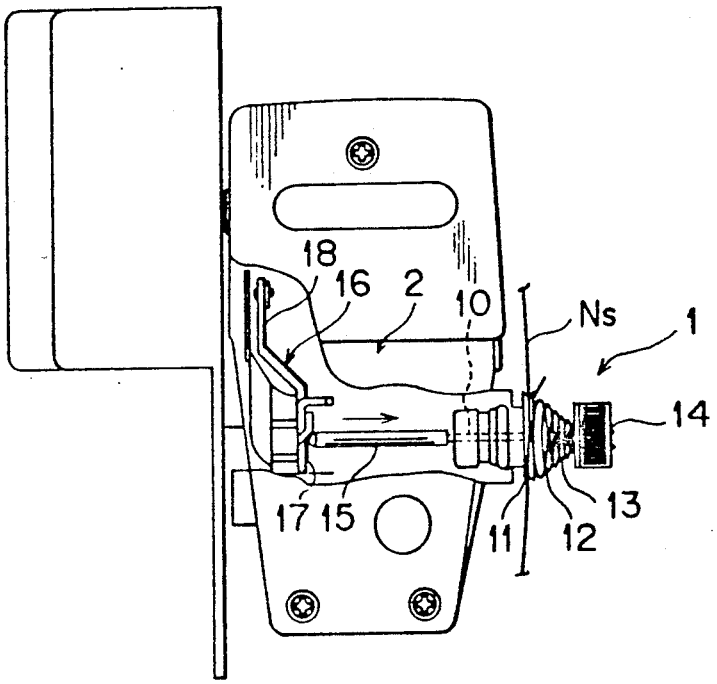
FIG. 2 is a partial side view of the sewing machine according to the one embodiment.

Firstly, with reference to FIGS. 1 and 2, described is a thread tension regulating mechanism 1 for applying resistive force to a needle thread Ns drawn from a thread reel (not shown) and a thread tension releasing mechanism 2 for releasing the resistive force.

As shown in FIGS. 1 and 2, a sewing machine M has an arm portion 6 provided with a head portion 8. In the head portion 8, a thread tension regulating shaft 10 is supported movably by a machine frame 5 in a horizontal direction (frontward and rearward directions, i.e., in FIG. 2, the right and left side of the frame 5 designates front and rear side thereof, respectively). A stationary thread tension regulating disc 11, a movable thread tension regulating disc 12 and a compression spring 13 are provided, and the thread tension regulating shaft 10 extends through the discs 11, 12 and the spring 13.

A needle thread Ns is interposedly positioned between the stationary and movable thread tension regulating discs 11 and 12. The thread tension regulating shaft 10 has a front end portion with which an adjusting knob 14 is threadingly engaged for adjusting resistive force applied to a needle thread Ns. Upon rotation of the adjusting knob 14 about its axis, the resistive force to be applied to the needle thread Ns is changed because of a change in biasing force of the compression spring 13. Incidentally, the thread tension regulating shaft 10 has a stepped portion with which the movable thread tension regulating disc 12 is engaged frontwardly. If the thread tension regulating shaft 10 is frontwardly displaced against the biasing force of the compression spring 13, the movable thread tension regulating disc 12 is moved away from the stationary thread tension regulating disc 11 for increasing a distance therebetween. As a result, any resistive force to be applied to the needle thread Ns is released.

A thread tension releasing shaft 15 is positioned rearwardly relative to the thread tension regulating shaft 10 and is supported movable in the frontward/rearward direction by the machine frame 5. The thread tension releasing shaft 15 is aligned coaxially with the tension regulating shaft 10. That is, the tension releasing shaft 15 has a front end face in abutting engagement with a rear end face of the tension regulating shaft 10, and has a rear end face in abutting engagement with a cam portion 17 of a thread tension releasing plate 16.

The cam portion 17 has an operative portion for frontwardly urging the thread tension releasing shaft 15, and a stepped down portion. The thread tension releasing plate 16 is also provided with a drive portion 18 connected to a plunger 21 of a thread tension releasing solenoid 20 by way of a connecting rod 19. A bracket 22 is fixedly secured to the machine frame 5, and the thread tension releasing solenoid 20 is fixedly mounted on the bracket 22. The plunger 21 is normally urged toward the drive portion 18 (leftwardly in FIG. 1) by a compression spring 23 disposed over the plunger 21.

In case of non-power supply to the thread releasing solenoid 20, the thread tension releasing shaft 15 is in abutment with the stepped down portion of the cam portion 17. Therefore, the shaft 15 does not urge the thread tension regulating shaft 10 frontwardly. Accordingly, a controlled braking or resistive force is applied to the needle thread Ns because of the controlled clamping force given by the stationary and movable discs 11 and 12. On the other hand, upon power supply to the thread tension releasing solenoid 20, the connecting rod 19 is moved toward the solenoid 20 (rightwardly in FIG. 1), so that the thread tension releasing plate 16 is rotated in one direction (clockwise direction in FIG. 1). Accordingly, the thread tension releasing shaft 15 is brought into abutment with the operative portion of the cam portion 17 for urging the thread tension regulating shaft 10 frontwardly. As a result, the movable thread tension regulating disc 12 is moved away from the stationary thread tension regulating disc 11 for releasing braking or resistive force to the needle thread Ns.

Next, a thread cutting mechanism 3 will be described for cutting the needle thread Ns and a bobbin thread Bs with reference to FIGS. 3 and 4. However, the thread cutting mechanism per se is disclosed in a Japanese Patent Application Kokai No. 56-139793, and therefore, the cutting mechanism 3 will be briefly described without detailed explanation.

Figure 4:
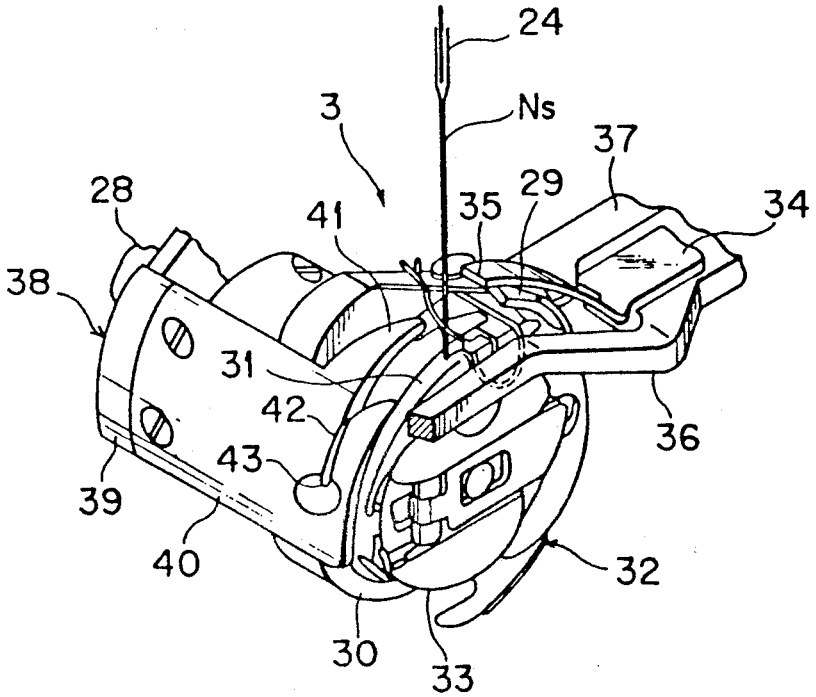
FIG. 4 is a perspective view showing a thread loop trapping unit and a thread cutting unit according to the one embodiment.
Figure 3:
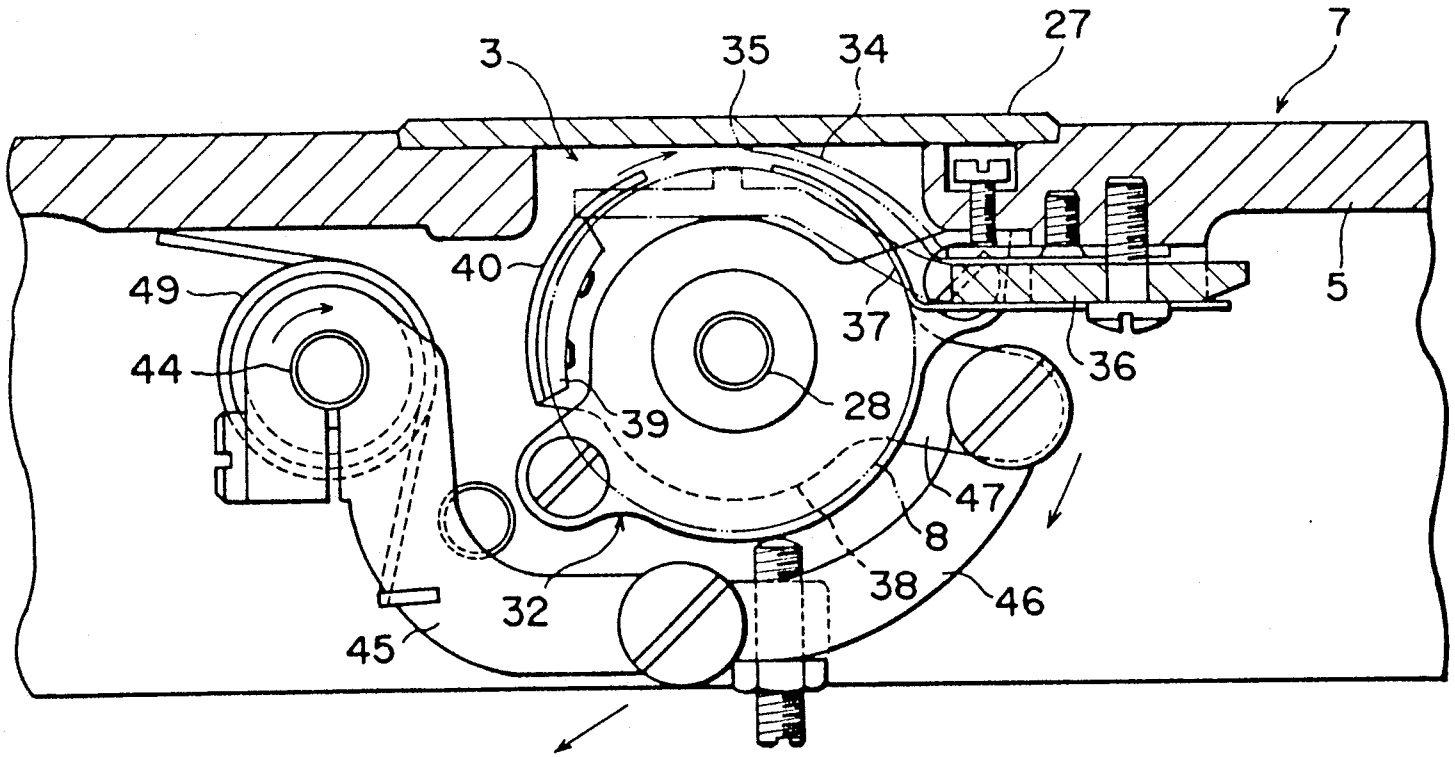
FIG. 3 is a side elevational view showing an essential portion of a bed portion according to one embodiment of this invention.

In FIGS. 3 and 4, the sewing machine has a bed portion 7 in which provided is a throat plate 27 formed with a needle hole (not shown) for allowing a sewing needle 24 to reciprocally pass therethrough. At a portion of the machine frame 5 at a position below the throat plate 27, a rotating hook shaft 28 is rotatably supported. Further, at one side of the rotating hook shaft 28 a full-rotation type loop trapping unit 32 is provided which includes a hook 29, a shuttle race body 30 and a shuttle body 31, and which is generally referred to as a shuttle race complete or a loop taker. While a bobbin case 33 which stores therein a bobbin (not shown) is assembled in the shuttle body 31, the needle thread Ns and the bobbin thread Bs are engaged with each other in cooperation with a vertical reciprocating motion of the sewing needle 24, so that a seam is formed on a workpiece W.

At a portion of the machine frame 5 and at a front position of the thread loop trapping unit 32, a stationary blade 34 is provided whose front half portion is secured to the frame 5 by a screw. A rear half portion of the stationary blade 34 extends arcuately along the thread loop trapping unit 32 to a position close to the thread hole of the throat plate 27. The rear end portion of the stationary blade 34 is formed with a blade edge 35. Incidentally, a shuttle body latch 36 is provided for preventing the shuttle body 31 from its rotation, and further, a shield plate 37 is provided for preventing the needle thread Ns from being entangled with the stationary blade 34 when the thread Ns is upwardly lifted and disengaged from the hook 29.

A portion of the machine frame at a rear side of the thread loop trapping unit 32 pivotably supports a movable blade retainer 38. The movable blade retainer 38 is provided angularly rotatably about an axis of the rotating hook shaft 28. The retainer 38 has a blade fixing portion 39 to which a movable blade 40 having an arcuate shape is fixed by screws. The retainer 38 is also provided with a linking portion 47. One end portion of the arcuate movable blade 40 is provided with a thread trimming portion 41, a thread trapping portion or groove 42 and a blade edge 43.

For pivoting the movable blade 40, a pivot shaft 44 is provided which is driven by a cam drive mechanism (not shown). Further, a pivot arm 45 is fixedly secured to the pivot shaft 44, and the pivot arm 45 is connected to the linking portion 47 of the movable blade retainer 38 through a linking lever 46. Furthermore, the cam drive mechanism (not shown) is drivingly connected to a drive shaft of a thread cutting solenoid 48 shown in FIG. 9 so as to drive the cam drive mechanism by the rotation of the rotating hook shaft 28.

In FIG. 3, a torsion spring 49 is provided for urging the pivot arm 45 in one direction (counterclockwise direction in FIG. 3), to thereby urge the movable blade 40 to its non-cutting position shown in FIG. 3. Therefore, as described later, if the thread cutting solenoid 48 undergoes electrical power supply by a predetermined timing when the sewing operation is terminated, the cam drive mechanism (not shown) is driven by the rotation of the rotating hook shaft 28, so that the pivot shaft 44 is rotated about its axis in a direction indicated by an arrow. Accordingly, the movable blade retainer 38 is also angularly rotated in a clockwise direction in FIG. 3 through the pivot arm 45 and the linking lever 46. Consequently, the movable blade 40 is also pivotally moved in the clockwise direction in FIG. 3. As a result, the movable blade 40 simultaneously traps the needle thread Ns and the bobbin thread Bs those succeeding from the workpiece at a timing where the thread loop of the needle thread Ns is disengaged from the hook 29 of the shuttle race body 30 and is lifted upwardly. Therefore, the needle thread Ns and the bobbin thread Bs are subjected to cutting by the sliding engagement between the blade edge 35 of the stationary blade 34 and the blade edge 43 of the movable blade 40. In this case, a length relative to the needle thread Ns between the exactly cutting point and an eye 25 of the sewing needle 24 (this length of the needle thread Ns will be referred to as "a length of a needle thread leading end portion") is proportional to a length of the thread trapping groove 42. In this connection, if the length of the groove 42 is reduced, the length of the needle thread leading end portion can also be reduced.

Next, descriptions will be given with reference to a holding mechanism 51 for holding the leading end portion of the needle thread Ns which has been cut after the sewing operation is completed, and to a driving mechanism 52 for driving the holding device with reference to FIGS. 5 through 13(*c*).

Figure 7:
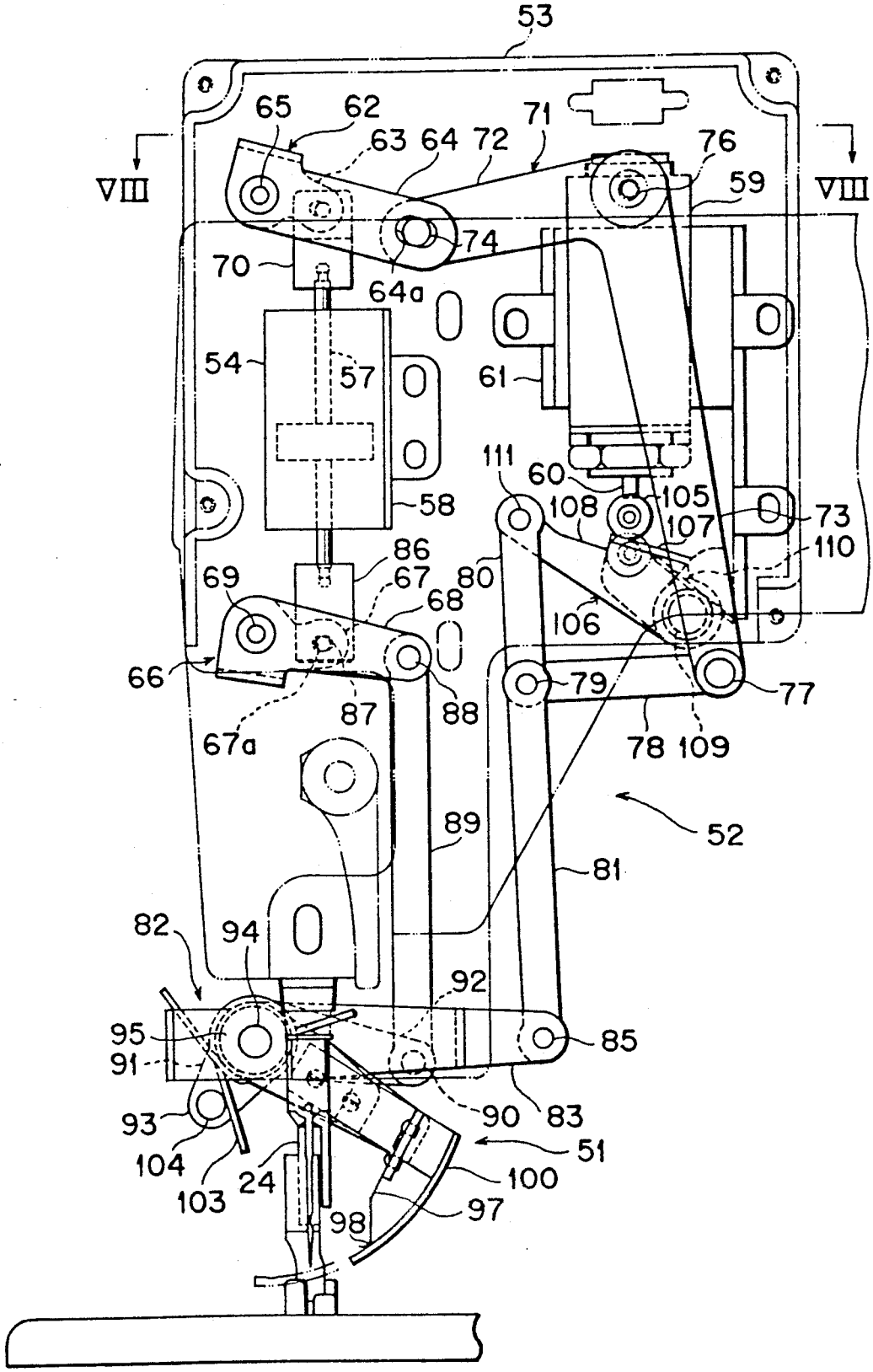
FIG. 7 is a cross-sectional view taken along the line VII—VII of FIG. 6.
Figure 8:
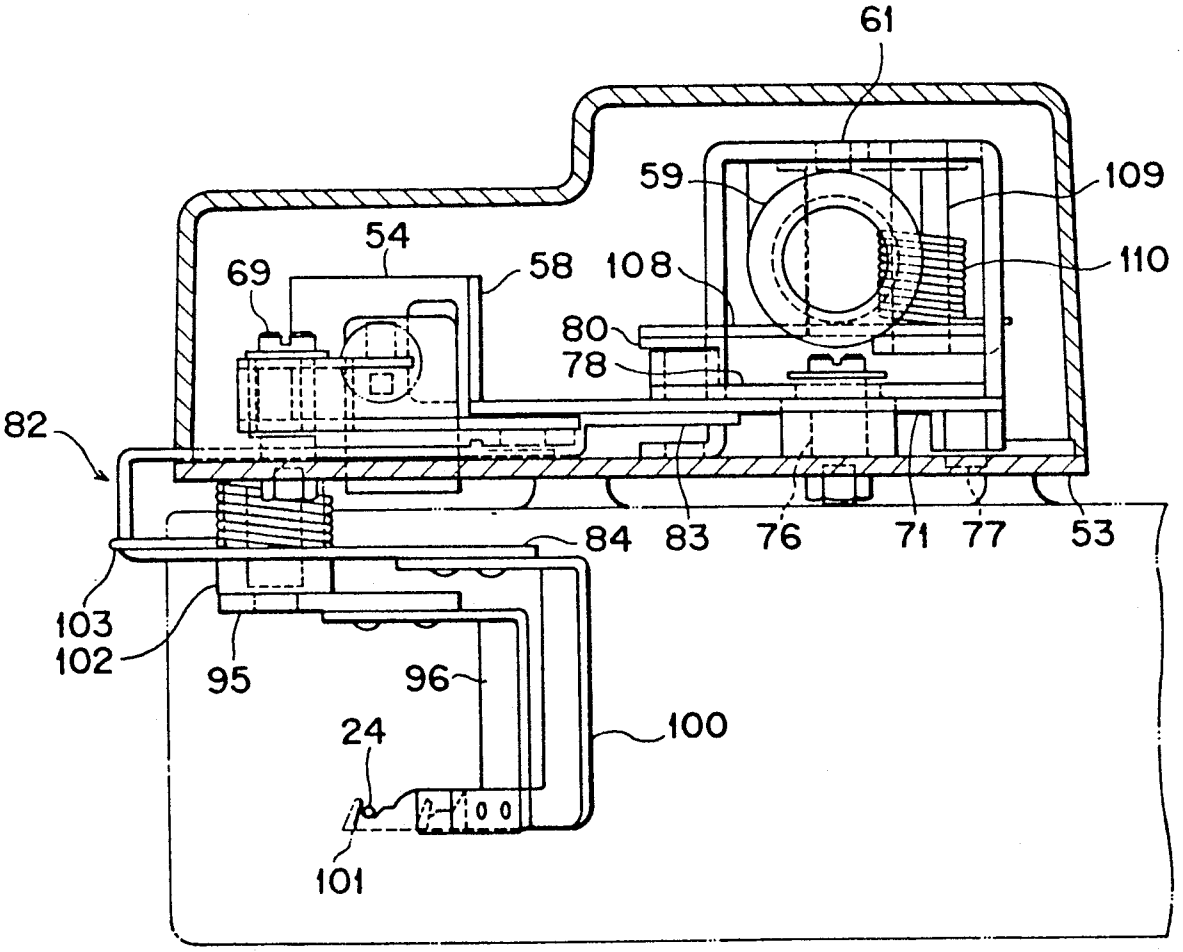
FIG. 8 is a cross-sectional view taken along the line VIII—VIII of FIG. 7.
Figure 12:
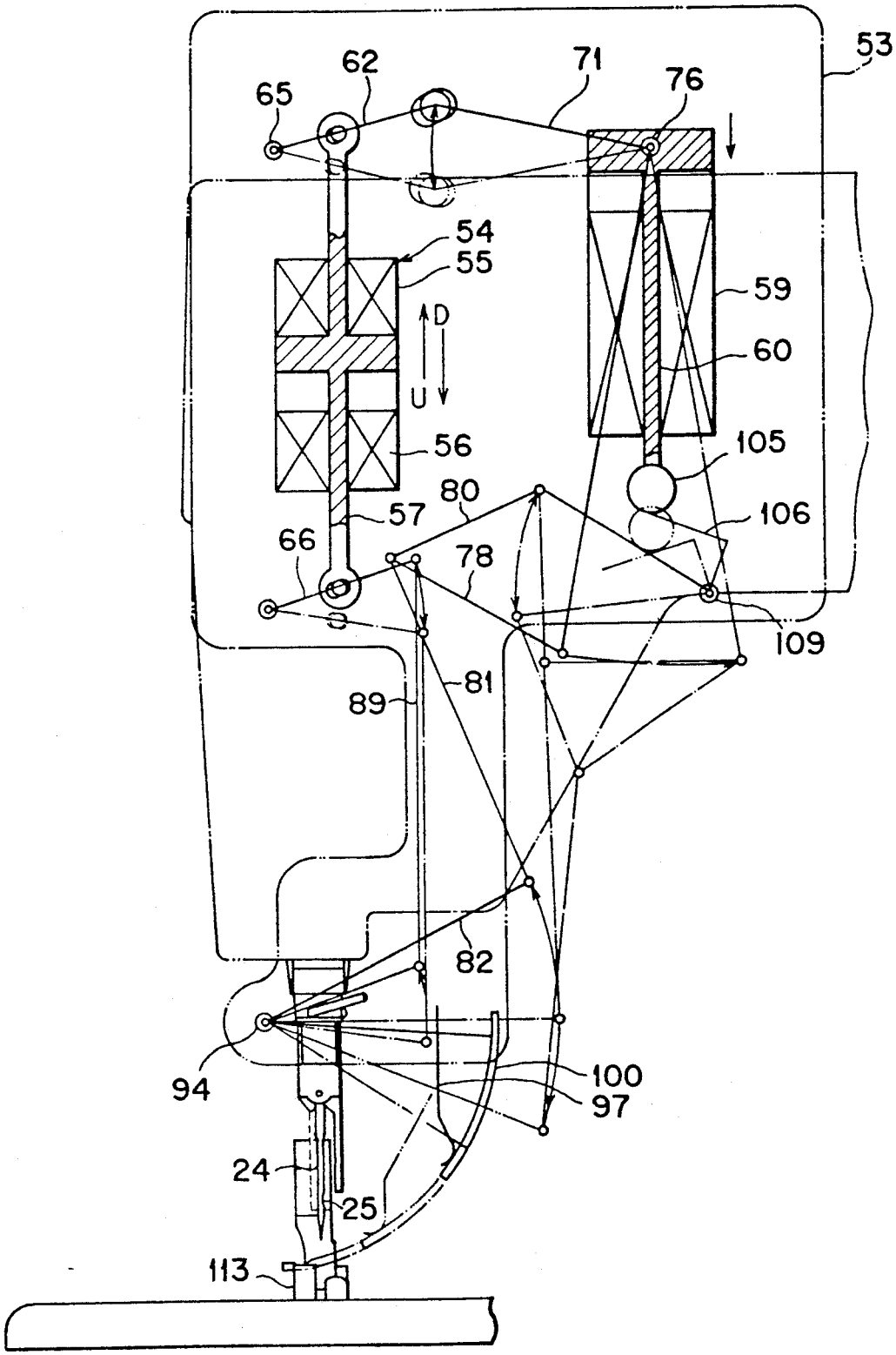
FIG. 12 is a view for description of operations of the needle thread leading end holding mechanism and its driving mechanism according to one embodiment of this invention.

As shown in FIGS. 5 through 8, at a rear side of the head portion 8 of the sewing machine M, an attachment plate 53 extending in a vertical direction is fixed by screws, and a second solenoid (bistable latching solenoid) 54 extending in a vertical direction is fixedly secured to the attachment plate 53 through a bracket 58. Further, a first solenoid 59 extending in the vertical direction is also fixedly secured to the attachment plate 53 through a bracket 61. In FIG. 8, the second and the first solenoids 54 and 59 are fixed to left part and right part of the attachment plate 53, respectively. As shown in FIG. 12, the second solenoid 54 is provided with an ascent solenoid 55 and a descent solenoid 56, and a plunger 57. If the ascent solenoid 55 is actuated, the plunger 57 is moved upwardly in a direction indicated by an arrow U and the ascent position of the plunger 57 is maintained. On the other hand, if the descent solenoid 56 is actuated, the plunger 57 is moved downwardly in a direction indicated by an arrow D and the descent position of the plunger 57 is maintained.

Figure 5:
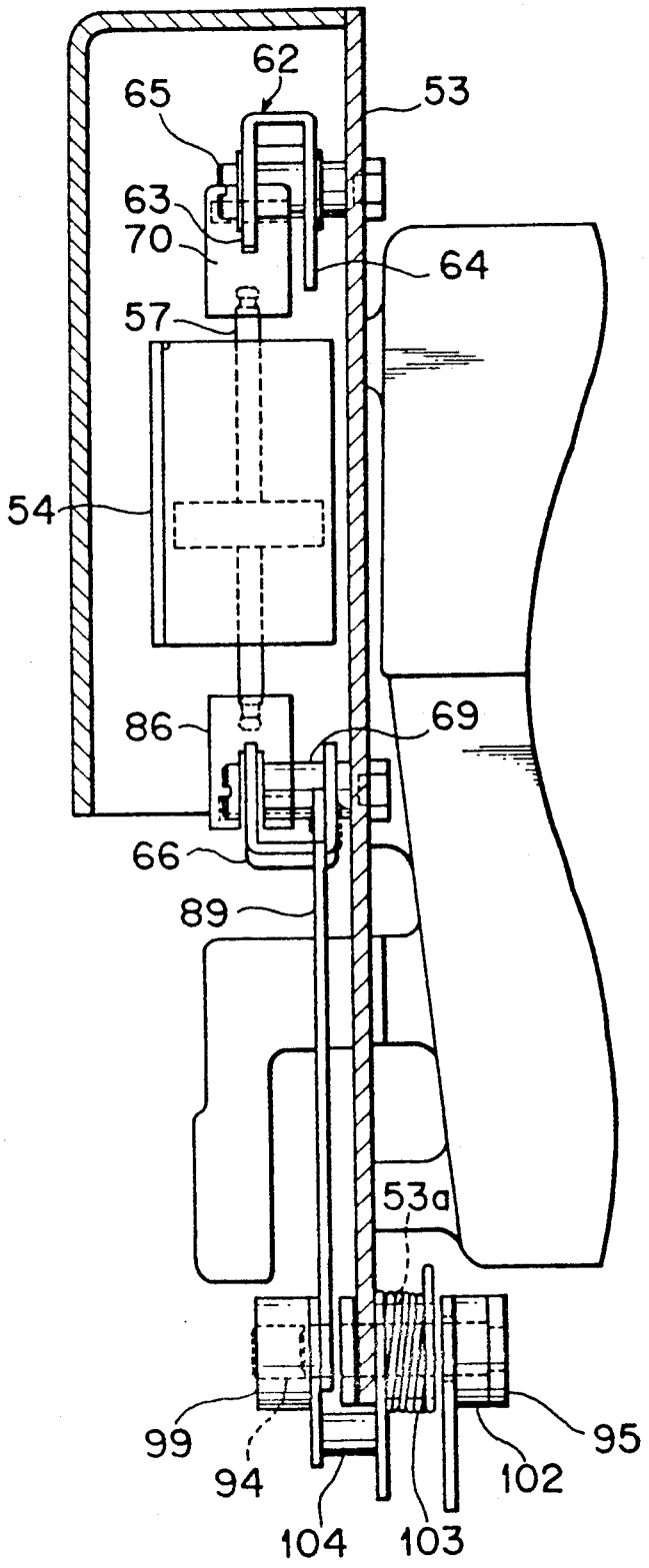
FIG. 5 is a partial side view showing a thread holding device driving mechanism according to one embodiment of this invention.
Figure 6:
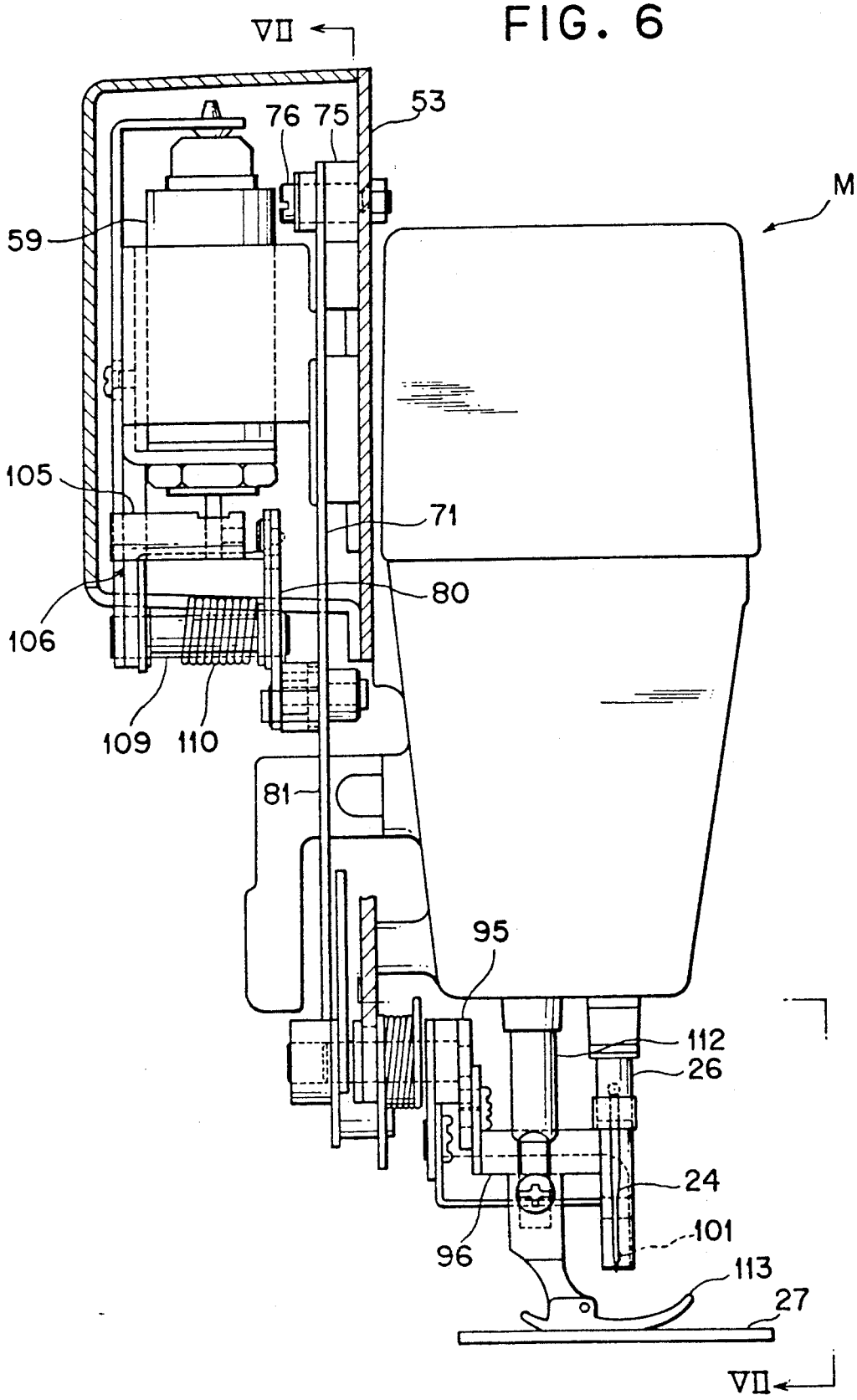
FIG. 6 is a side view showing the thread holding device driving mechanism and a needle thread leading end holding mechanism according to one embodiment of the present invention.

As shown in FIGS. 5, 7 and 12, a first output link 62 having U-shape cross-section (see FIG. 5) is positioned immediately above the second solenoid 54. The first output link 62 is pivotally supported to the attachment plate 53 by a pin 65 extending in frontward/rearward direction. Further, a second output link 62 having U-shape cross-section is also provided at a position immediately below the second solenoid 54. The second output link 62 is pivotally supported to the attachment plate 53 by a pin 69 extending in frontward/rearward direction. The first output link 62 is provided with a drive arm portion 63 and a pivot arm portion 64 formed with an elongated slot 64*a*, and the second output link 66 is provided with a drive arm portion 67 formed with an elongated slot 67*a*, and a swing arm portion 68. As best shown in FIG. 7, the drive arm portion 63 of the first output link 62 is rotatably connected to a linking member 70 fixed to an upper end portion of the plunger 57 of the second solenoid 54.

A first link 71 having an L-shape configuration is pivotally supported to the attachment plate 53. That is, the first link 71 has a first arm 72 integrally provided with a pin 74, a second arm 73 and a base portion which is rotatably supported to the attachment plate 53 by a stepped screw 76 through a spacer 75. Further, there are provided with second link 78, a third link 80 and a fourth link 81.

The pivot arm portion 64 of the first output link 62 is rotatably connected to the first link 71 by the fitting engagement of the pin 74 with the elongated slot 64*a*. The second arm 73 of the first link 71 has a lower end portion rotatably connected to one end portion of the second link 78 through a stepped pin 77. Another end portion of the second link 78 is rotatably connected to a lower end portion of the third link 80 through a pin 79, and is also rotatably connected to an upper end portion of the fourth link 81 through the pin 79. A lower end portion of the fourth link 81 is rotatably connected to a one end portion of a drive arm portion 83 of a thread pickup link member 82 through a pin 85.

The drive arm portion 67 of the second output link 66 is rotatably connected to a link member 86 fixedly secured to the plunger 54 of the second solenoid 54. More specifically, the link member 86 is integrally provided with a pin 87 which is engageable with the elongated slot 67*a* of the second output link 66. One end portion of the pivot arm portion 68 of the second output link 66 is rotatably connected to an upper end portion of a fifth link 89, whose lower end portion is connected, by a pin 90, to a first arm 92 of a thread holding link member 91.

At a lower portion of the attachment plate 53, a boss portion 53*a* is fixed which extends in frontward/rearward direction. A pivot arm 94 extending in this direction is rotatably positioned and passes through the boss portion 53*a* and the attachment plate 53. The pivot shaft 94 has a front end portion fixed with a holder attaching plate 95 to which a thread retaining holder 95 is fixed by screws. Further, the thread retaining holder 96 is fixed with a holding force imparting member 97 such as a leaf spring member by screws. A tip end of the holding force imparting member 97 is formed with a downwardly protruding bent portion so as to constitute a thread holding portion or resiliently abutting portion 98.

A rear end portion of the pivot shaft 94 is fixed with the thread holding link member 91 having a boss portion 99 provided with a stepped portion. Therefore, in accordance with the upward or downward movement of the fifth link 89, the thread holding link member 91 is rotated about an axis of the pivot shaft 94 in a counterclockwise direction and clockwise direction in FIG. 7, so that the holding force imparting member 97 is rotated in synchronism with the thread holding link member 91 in the counterclockwise or clockwise direction through the pivot shaft 94, the holder attaching plate 95 and the thread retaining holder 96.

The thread pickup link member 82 has a U-shape cross-section, and has the drive arm portion 83 (FIG. 7) and a pivot arm portion 84 (FIG. 8). The pivot shaft 94 extends through a base end portions of the arms 83 and 84, so that the thread pickup link member 82 is pivotally supported by the pivot shaft 94. A spacer 102 is interposed between the pivot arm 84 and the holder attaching plate 95. Further, a thread holding member 100 is fixed to the pivot arm 84 by screws. The thread holding member 100 has an arcuate shape whose radial center is coincident with an axis of the pivot shaft 94. As best shown in FIG. 8, the thread holding member 100 is formed with a hook portion or thread trapping portion 101 at a free end portion thereof for trapping the needle thread Ns which is insertedly passed through the eye 25 of the sewing needle 24 and extends downwardly. The hook portion 101 defines a top recessed portion.

If the thread holding portion 98 of the holding force imparting member 97 is brought into resilient abutment with the recessed portion of the hook portion 101, a leading end portion of the needle thread Ns is held or clamped by the thread holding portion 98 and the hook portion 101. In accordance with upward or downward movement of the fourth link 81, the thread pickup member 82 is rotated about the axis of the pivot shaft 94 in the counterclockwise or clockwise direction in FIG. 7, so that the thread holding member 100 is rotated about the axis in the same direction.

A coil spring 103 is disposed over the pivot shaft 94 and is interposed between the pivot arm portion 84 and the attachment plate 53. One end of the coil spring 103 is engaged with the base end portion of the thread pickup link member 82, whereas another end portion of the coil spring 103 is latched with a pin 104 fixed to a second arm 93 of the thread holding link member 91. In FIG. 7, the thread pickup link member 82 is normally urged against the thread holding link 91 in one rotational direction (counterclockwise direction), and the thread holding link 91 is normally urged against the thread pickup link member 82 in the opposite rotational direction (clockwise direction). Therefore, the thread holding portion 98 of the thread holding force imparting member 97 surely abuts the hook portion 101 of the thread holding member 100. Incidentally, the drive arm portion 83 and the pivot arm portion 84 of the thread pickup link member 82 are intersected with each other at an angle of about 30 degrees.

The first solenoid 59 has its plunger 60 whose lower end portion is fixed with a pin 105 extending in frontward/rearward direction. Further, a pin 109 extends in frontward/rearward direction from the lower portion of the bracket 61, and a third output link 106 having U-shape cross-section is provided pivotable about the pin 109. The third output link 106 includes an abutment portion 107 and a pivot arm portion 108. Further, a torsion spring 110 is disposed over the pin 109 so as to urge the abutment portion 107 of the third output link 106 toward the pin 105, so that the abutment portion 107 is continuously in contact with the lower face of the pin 105.(the abutment portion 107 is urged to be rotated in the clockwise direction in FIG. 7 by the torsion spring 110). Furthermore, the pivot arm portion 108 of the third output link 106 is pivotally connected to the upper portion of the third link 80 by a pin 111 extending therefrom. Incidentally, a pressure bar 112 and a pressure foot 113 are provided as known manner.

Figure 13A:
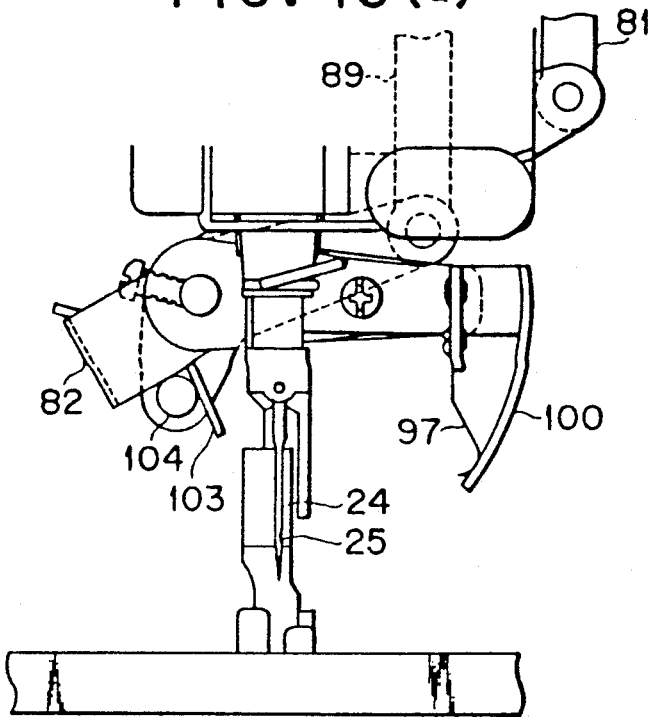
FIG. 13(*a*) through 13(*c*) are partial front views showing various operational phases of the thread holding device according to one embodiment of this invention.
Figure 13B:
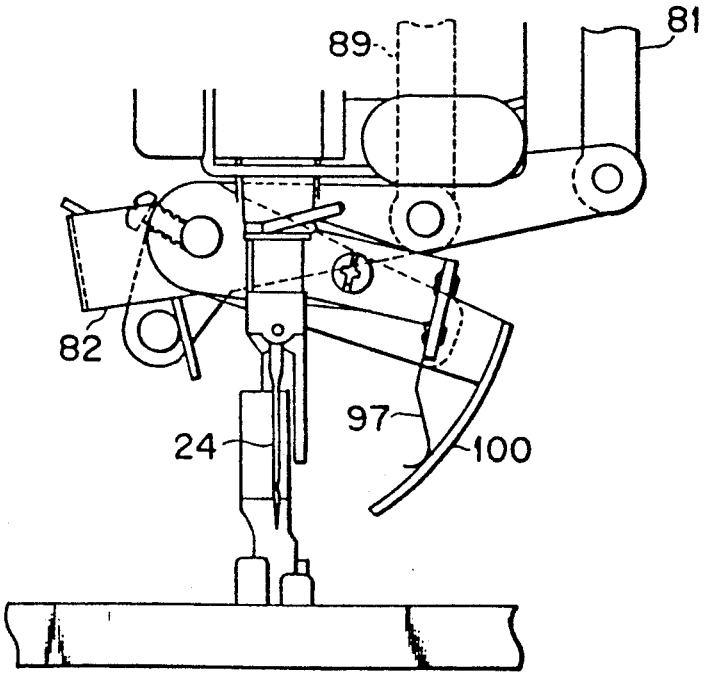
Figure 13C:
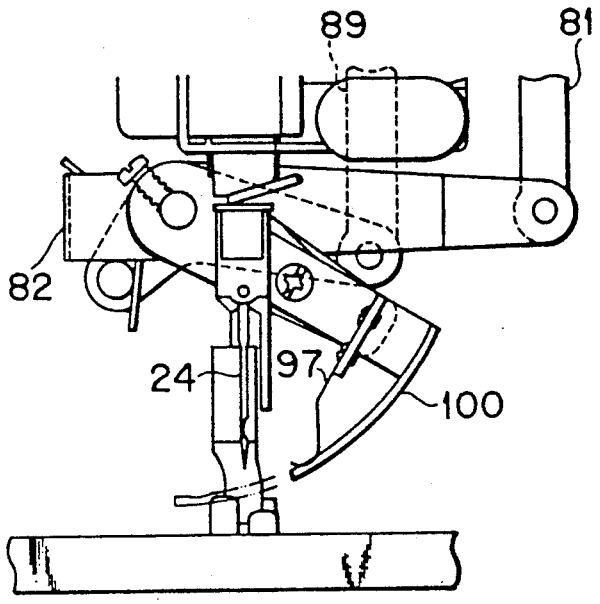

Next, operations of the needle thread leading end holding mechanism 51 and driving mechanism 52 for driving the holding mechanism 51 will be described below with reference to FIGS. 7, 12 and 13(*a*) through 13(*c*).

When the ascent solenoid 55 is actuated, the plunger 57 is moved upwardly to its ascent position shown in FIG. 12. Therefore, through the linking member 70, the first output link 62, the first link 71, the second link 78 the fourth link 81, the thread pickup link member 82 and the thread holding member 100 are brought into positions shown by solid lines in FIG. 12. In this case, the thread holding member 100 has its retracted position or "a third position". On the other hand, in accordance with upward movement of the plunger 57, the fifth link 89, the thread holding link 91, the holder attaching plate 95, the thread retaining holder 96 and the holding force imparting member 97 are moved, by way of the linking member 86, to solid line positions in FIG. 12. In this instance, the holding force imparting member 97 has its retracted position also shown in FIG. 13(*a*). In this retracted position, the thread holding member 100 is largely angularly rotated (in counterclockwise direction in FIG. 13(*a*)), so that its hook portion 101 is positioned far above the throat plate 27.

Next, if the descent solenoid 56 is actuated, the plunger 57 is moved to its descent position shown in FIG. 12. By the downward movement of the plunger 57, through the linking member 70, the first output link 62, the first link 71, the second link 78, the fourth link 81, the thread pickup link member 82, and the thread holding member 100 are moved to positions indicated by dotted chain lines in FIG. 12. In this case, the thread holding member 100 has its thread holding position or "a second position". In the second position, the hook portion 101 of the thread holding member 100 is positioned beside the needle 24 which is positioned at its uppermost position. On the other hand, in accordance with the downward movement of the plunger 57, through the linking member 86, the second output link 66, the fifth link 89, the thread holding link 91, the holder attaching plate 95, the thread retaining holder 96 and the holding force imparting member 97 are moved to positions indicated by dotted chain lines in FIG. 12. Further, in this case, the thread holding portion 98 of the holding force imparting member 97 is brought into engagement with the recess of the hook portion 101 as shown in FIG. 13(*c*), so that the needle thread Ns is about to be held between the hook portion 101 and the thread holding portion 98.

With this state, if the first solenoid 59 is actuated, the plunger 60 is moved downwardly, and therefore, through the pin 105, the third output link 106, the third link 80, the fourth link 81, the thread pickup link member 82 and the thread holding member 100 are moved to positions indicated by two dotted chain lines in FIG. 12. In this case, the hook portion 101 of the thread holding member 100 is positioned immediately below the sewing needle 24 which is positioned at its uppermost position, and therefore, the leading end portion of the needle thread Ns extending through the eye 25 of the needle 24 and directed downwardly is trapped. This position of the thread holding member 100 is referred to as a thread trapping position or "a first position".

If the first solenoid 59 is deenergized, the third output link 106, the third link 80, the fourth link 81 and the thread pickup link member 82 return back to their positions shown by a dotted chain lines in FIG. 2 because of the biasing force of the spring 110. Therefore, the thread holding member 100 moves back to the thread holding position or the second position as shown in FIG. 13(*c*) while the hook portion 101 maintains trapping to the leading end portion of the needle thread Ns. In cooperation with the thread holding portion 98 of the holding force imparting member 97, the leading end portion of the needle thread Ns is held or clamped.

Further, if the ascent solenoid 55 is actuated, the thread holding member 100 and the holding force imparting member 97 are moved to their retracted positions. In this case, since the second link 78, the third link 80 and the fourth link 81 provide four linking points for moving the thread holding member 100, the moving speed of the thread holding member 100 is lower than the moving speed of the holding force imparting member 97 at an initial phase of moving toward their retracted positions. Accordingly as shown in FIG. 13(*b*), the thread holding portion 98 of the holding force imparting member 97 is disengaged from the hook portion 101 for releasing the leading end portion of the needle thread Ns. The position of the thread holding member 100 can be referred to as a thread releasing position.

Figure 9:
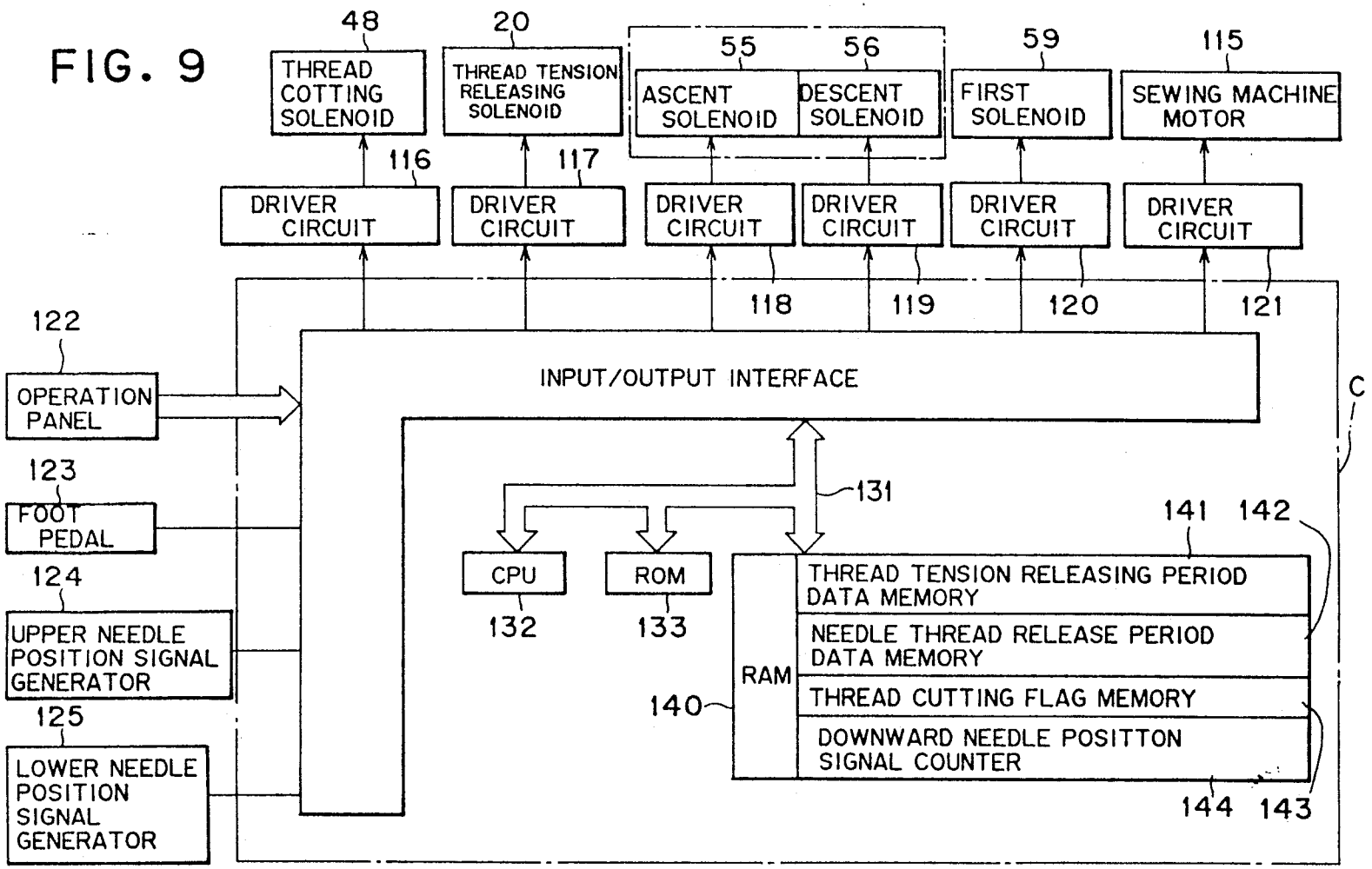
FIG. 9 is a block diagram showing a sewing machine control system according to the one embodiment.

Next, a control system for controlling overall operation of the sewing machine M of the present invention will be described with reference to FIG. 9.

A thread cutting solenoid 48, a thread tension releasing solenoid 20, the ascent solenoid 55, the descent solenoid 56, the first solenoid 59 and a sewing machine motor 115 are connected to their respective driver circuits 116 through 121, respectively, and these driver circuits are connected to an input/output interface 130 of a control device C.

An operation panel 122 is connected to the input/output interface 130. The operation panel 122 has a release period setting key, a thread tension releasing period setting key and a retract command key. The release period setting key is adapted for setting a releasing timing (a second predetermined period) for releasing the leading end portion of the needle thread Ns counting from the sewing start timing. The thread tension releasing period setting key is adapted for setting a period (a first predetermined period) in which the needle thread tension is released by the thread tension releasing mechanism 2, this period being counted from immediately after the sewing start timing. The retract command key is adapted for forcibly moving the thread holding member 100 and the holding force imparting member 97 to their retracted positions in case where the sewing needle is to be changed with a new needle, or the needle thread is to be passed through the eye of the needle 24. The thus set data indicative of the periods or the command signal are outputted to the interface 130.

A foot pedal 123 is also connected to the input/output interface 130. The foot pedal has a front pedal-in position at which generated is a sewing machine energization command signal, rear pedal-in position at which generated is a thread cutting signal, and a horizontal neutral position at which generated is the sewing machine operation stop command signal. These signals are outputted to the input/output interface 130.

An upper needle position signal generator 124 is provided for generating upper needle position signal when the sewing needle 24 has its uppermost position. More specifically, a disc member formed of a metal is disposed on a main spindle shaft (not shown) driven by the sewing machine motor 115. The disc member is formed with a small opening positioned at a predetermined circumferential position, and a rotational position of the disc member is detected by means of a proximity switch (not shown) by detecting the opening. The upper needle position signal is transmitted to the input/output interface 130.

A lower needle position signal generator 125 is provided for generating a lower needle position signal when the sewing needle 24 has its lowermost position. A structure of the generator 125 is the same as that of the generator 124. The lower needle position signal is also transmitted to the input/output interface 130.

The control device C includes a central processing unit (CPU) 132, the input/output interface 130 connected to the CPU 132 through a data bus 131, a ROM 133 and a RAM 140. In the ROM 133, stored is a control program for a control to the needle thread Ns such as the needle thread holding control and needle thread tension releasing control. In the RAM 140, provided are a needle thread tension releasing period data memory 141 for storing therein the data set by the thread tension releasing period setting key of the operation panel 122, a needle thread release period data memory 142 for storing therein the data set by the thread release period setting key, a thread cutting flag memory 143, a downward needle position signal counter 144 and various memories for temporarily storing therein computed data computed in the CPU 132. The thread cutting flag memory 143 stores therein a thread cutting flag which is set when the foot pedal 123 is shifted to the rear pedal-in position through the neural position, and which is reset when the foot pedal is not shifted to the rear pedal-in position. The downward needle position signal counter 144 counts the downward needle position signal inputted from the downward needle position signal generator 125, and count value is represented by "I" in the description below.

Figure 10:
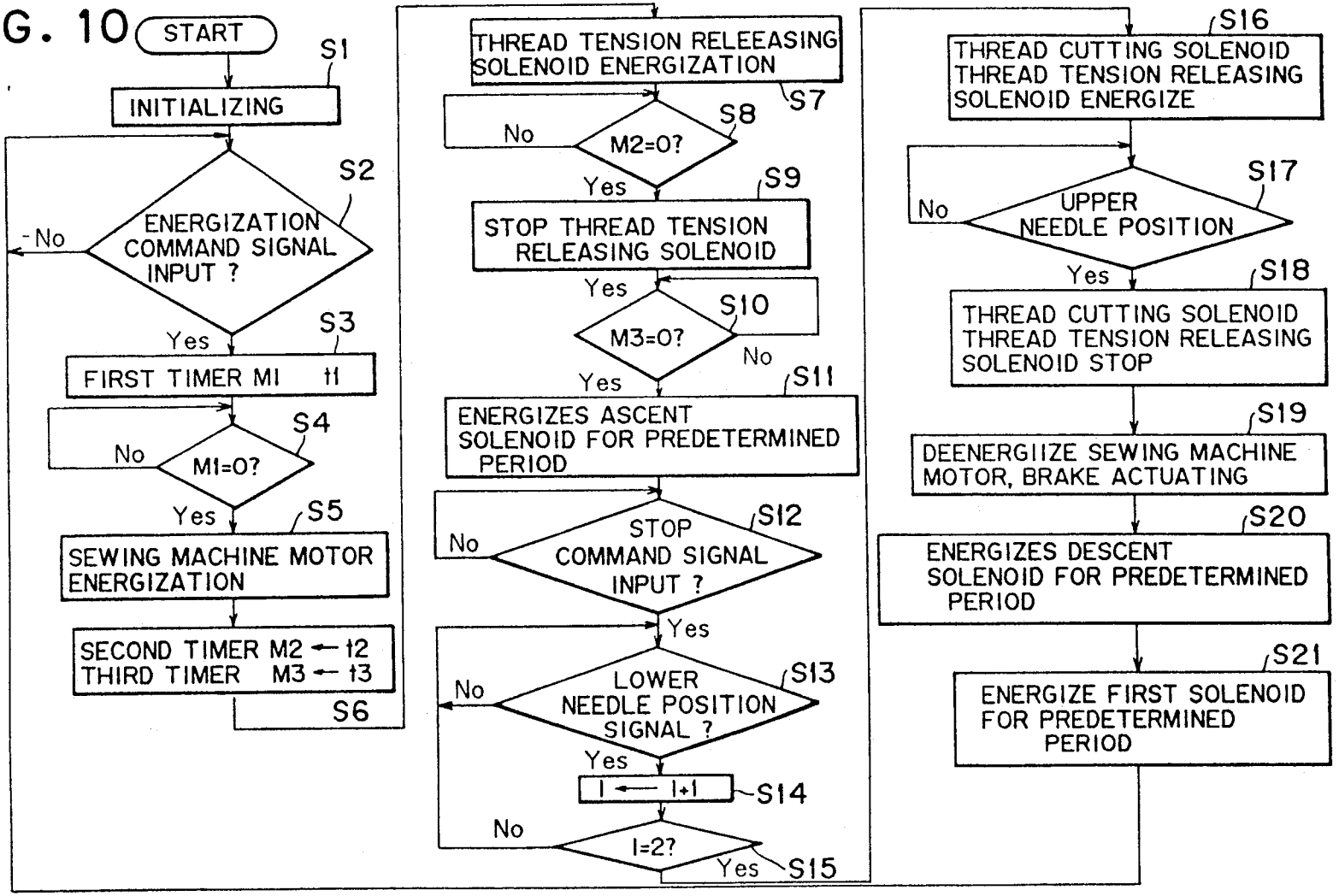
FIG. 10 is a flow chart showing a control routine for the upper thread processing such as a control to the needle thread holding and a control to thread tension releasing according to one embodiment of this invention.

Next, a routine in the control device C regarding control to the needle thread Ns will be described with reference to a flowchart shown in FIG. 10 in conjunction with FIGS. 11 through 13(*c*). For a simplicity, however, explanation is made referring first to step S12. (step S1 to S11 will be described after description of step S21).

Figure 11:
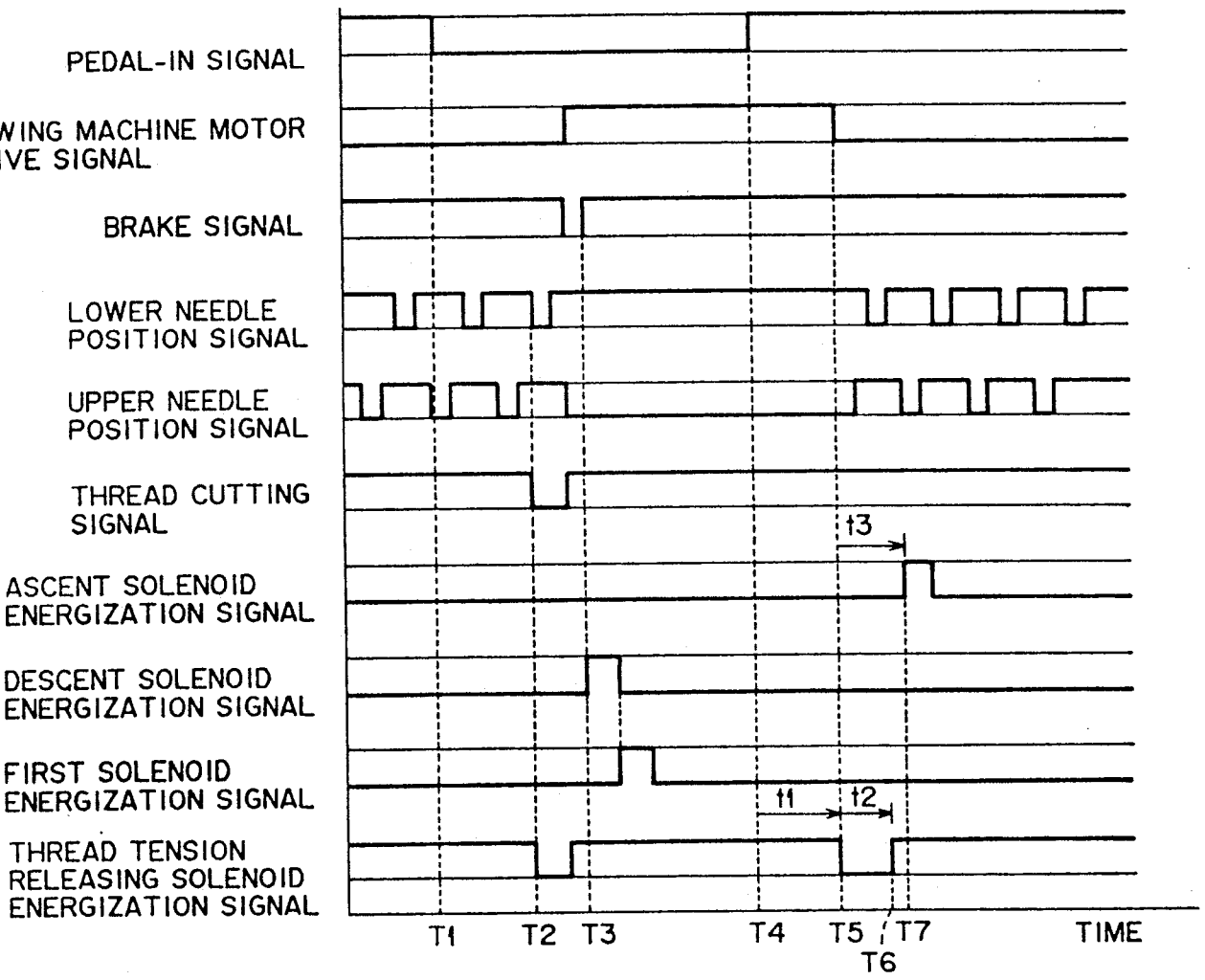
FIG. 11 is a timing chart showing timed relationship among various signals in one embodiment of this invention.

During sewing operation and at a timing T1 (FIG. 11), if the foot pedal 123 is shifted to the rear pedal-in position through the neutral position, the pedaling signal in FIG. 11 is at low level, and the thread cutting flag of the thread cutting flag memory 143 is set in step S12. If two downward needle position signals are inputted (if count value I becomes "2") from the downward needle position signal generator 125 at a timing T2 in steps S13 through S15, the thread cutting solenoid 48 and the thread tension releasing solenoid 20 are energized, so that the needle thread Ns and the bobbin thread Bs are subjected to cutting in step S16 while any resistive force applied to the needle thread Ns is released.

Then, if the upper needle position signal is inputted from the upper needle position signal generator 124 in step S17, the thread cutting solenoid 48 and the thread tension releasing solenoid 20 are deenergized in step S18, and the sewing machine motor 115 is deenergized and at the same time, the operation of the sewing machine motor 115 is completely terminated in step S19 upon actuation of a brake within the sewing machine motor 115 at a timing T3.

At the timing T3 where the sewing machine motor 115 is completely stopped, the descent solenoid 56 is energized for a predetermined period such as for 60 msec. in step S20. Accordingly, as described above, the thread pickup link member 82 and the thread retaining link 91 are moved from their solid line positions to their a dotted line positions as shown in FIG. 12. Consequently, the thread holding member 100 and the holding force imparting member 97 are moved to their thread holding positions as shown in FIG. 13(*c*). Then, the first solenoid 59 is energized for a predetermined period such as for 60 msec. in step S21. Accordingly, only the thread holding member 100 is displaced to its thread trapping position, so that the leading end portion of the needle thread Ns extending through the eye 25 of the needle 24 is trapped by the hook portion 101, and then, the thread holding member 100 is again moved back to the thread holding position. As a result, the thread leading end portion is held by the thread holding portion 98 of the holding force imparting member 97 and the hook portion 101 of the thread holding member 100.

Next, in order to start sewing operation, if the foot pedal 123 is shifted to the front pedal-in position, high level pedaling signal is generated at a timing T4 in step S2. In this case, a predetermined period t1 such as 100 msec. is stored in a first timer M1 provided in the control device C, and starts counting in step S3. Upon elapse of the predetermined period t1 and at a timing T5 in Step S4, the sewing machine motor 115 is energized in response to the sewing machine motor drive signal. Then, the set data t2 in the thread tension releasing period data memory 141 and another set data t3 in the needle thread release period data memory 142 are respectively stored in a second timer M2 and a third timer M3 those provided in the control device C in step S6. Further, thread tension releasing solenoid 20 is energized in steps S7 and S8 during a period bridging from energization timing of the sewing machine motor to a time-up timing of the second timer M2. This period corresponds to a period in which the needle 24 is moved from its uppermost position to its lowermost position and a needle thread loop is trapped by the thread loop trapping unit 32 after the sewing needle moves upwardly from its lowermost position to provide the thread slack.

After the time-up of the second timer M2 at a timing T6, and after the time-up of the third timer M3 at a timing T7, that is, after the elapse of a period in which the needle 24 is moved downwardly from its uppermost position and the needle thread loop is formed and a knot is provided by the engagement between the needle thread Ns and the bobbin thread Bs in steps S9 and S10, the ascent solenoid 55 is energized for a predetermined period such as for 60 msec. in step S11. In this case, the needle thread Ns is released from the thread holding member 100. More specifically, in this instance, the thread holding member 100 and the holding force imparting member 97 are both positioned at their thread holding positions shown in FIG. 13(*c*) and these are about to be moved to their retracted position shown in FIG. 13(*a*). When, these are to be moved to their retracted positions, the thread holding member 100 has the thread releasing position shown in FIG. 13(*b*) because of difference in moving velocity of the members 100 and 97 as described above. Thereafter, continuous sewing operation is carried out and control routines S11 et seq. are executed.

In the above illustrated embodiment, for determining the period t2, the timer M2 is used as described in Steps S5 through S8. However, it is also possible to make use of the lower needle position signal generator 125 so as to define the period t2. That is, the period t2 is started when the sewing machine motor energization signal is inputted into the control unit C as described above, and is ended when a "first" lower needle position signal (after the energization of the sewing machine motor) is inputted therein and the latter inputting state is abut to be terminated. During this period t2, the thread tension releasing solenoid is actuated for releasing the needle thread tension (in FIG. 11, it should be noted that the falling edge of the thread tension releasing solenoid energization signal at the timing T6 is almost coincident with the falling edge of the lower needle position signal. In the first pulse of the lower needle position signal in FIG. 11 after the timing T5, a rising edge implies downward motion of the sewing needle, an intermediate point of the pulse duration implies exactly the lowermost position of the sewing needle, and falling edge implies upward motion of the sewing needle, respectively. The duration still implies the lower needle position signal.

As described above, according to the embodiment, the needle thread tension is released by the thread tension releasing mechanism 2 during the thread tension releasing period t2 immediately after the start of sewing operation. Therefore, tensile force due to the vertical motion of a thread take-up lever may not be imparted to the needle thread Ns, and accordingly, the leading end portion of the needle thread Ns may not be disadvantageously disengaged from the thread holding mechanism 51. Further, since the leading end portion of the needle thread Ns is held by the thread leading end holding mechanism 51 during a period starting from the start timing of sewing and ending at the engagement between the bobbin thread Bs and the needle thread Ns at the first stitching, no skip stitching occurs, and the leading end portion of the needle thread Ns may not be disengaged from the eye 25 of the sewing needle 24.

Figure 14:
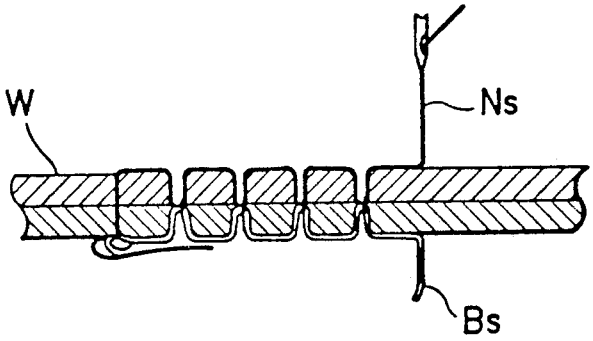
FIG. 14 is an enlarged cross-sectional view showing needle thread leading end portion and workpiece fabrics at an initial phase of sewing according to one embodiment.
Figure 15:
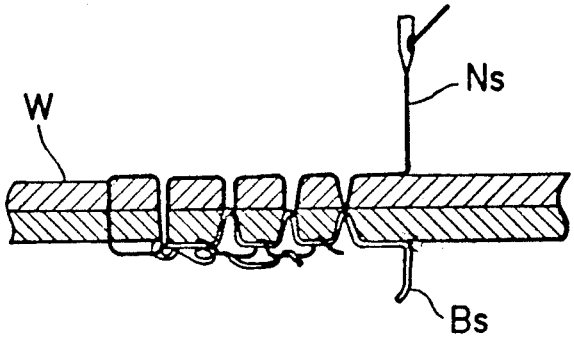
FIGS. 15 and 16 are cross-sectional views showing needle thread leading end portions and workpieces at an initial phase of sewing according to a conventional arrangement.
Figure 16:
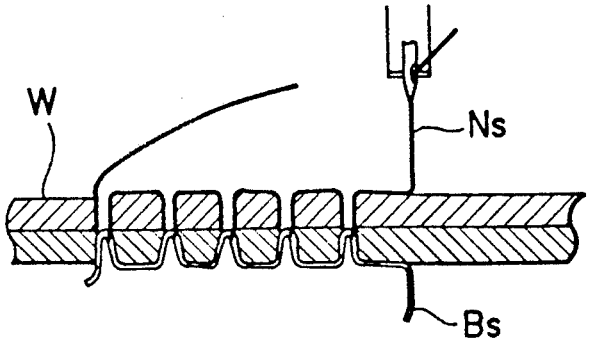

Furthermore, since the leading end portion of the needle thread Ns is held by the thread leading end holding mechanism 51 at a position closely beside the sewing needle 24 which is positioned at its uppermost position, the needle thread Ns can be cut by the thread cutting mechanism 3 in such a manner that the length of the leading end portion of the needle thread can be reduced. Therefore, since the length of the leading end portion can be reduced or minimized, the leading end portion is shifted to the back surface of the fabric as shown in FIG. 14 because of the subsequent second stitchings, and further, any thread entanglement between the bobbin thread Bs and the leading end portion of the needle thread in a nest like fashion can be obviated, so that manual thread pick-up operation can be dispensed with, and high stitching quality is attainable even at the initial stitching zone.

In the above described embodiment, conventional relevant mechanisms are also available instead of the thread tension regulating mechanism 1, the thread tension releasing mechanism 2 and the thread cutting mechanism 3 those described above. Further, the disclosed thread leading end holding mechanism 51 and the driving mechanism 52 therefor are merely examples, and various changes and modifications may be made thereto.

In the sewing machine M having the thread cutting mechanism, the thread tension releasing control is important. In FIG. 11, the tension applied to the needle thread Ns is released during the period t2, and therefore, any resistive force to the needle thread Ns is released at the thread tension regulating mechanism 1 during this period t2. Accordingly, required length of the needle thread Ns can be supplied from the needle supplying source as a reel without tension application to the thread Ns. Consequently, disengagement of the needle thread Ns from the eye of the needle is avoidable.

At the first stitching, after the downward movement of the sewing needle 24, the thread take-up lever is also moved downwardly, and the needle thread loop is trapped by the loop trapping unit 32. More specifically, when the sewing needle 24 is positioned at its lowermost position, the needle thread is in tight contact with the sewing needle. However, when the sewing needle 24 begins to move upwardly from its lowermost position, the sewing needle may be slackened to provide the thread loop, since the thread part engaging with the workpiece is held stationarily because of the friction given by the workpiece. Therefore, the loop taker can enter into the space defined by the slackened needle thread and the sewing needle, to thereby trap the thread loop. In other words, the leading end portion of the needle thread Ns extending through the eye 25 of the needle 24 is merely subjected to resistive force against the workpiece W. Therefore, the leading end portion of the needle thread Ns is pulled by the hook, and is pulled toward the back side of the workpiece W, whereas length of the leading end portion of the needle thread Ns between the eye of the needle and the tip end of the thread can be maintained unchanged, and no knot is provided between the needle thread Ns and the bobbin thread Bs at the initial stitching.

As described above, in the present invention, at an initial start-up period of the sewing operation, disengagement of the leading end portion of the needle thread from the eye of the sewing needle is avoidable by releasing the tension imparted to the needle thread Ns, and further, the leading end portion of the needle thread Ns can be surely pulled toward the back side of the workpiece while maintaining the length of the leading end portion between the eye of the needle and the exact leading end point of the thread without any substantial change. Accordingly, by providing the thread cutting mechanism 3 which is capable of providing a reduced length of the leading end portion of the needle thread from the eye of the needle to the exact cutting point, reduced or minimized length of the leading end portion can remain on the back side of the workpiece without producing any disadvantageous nest like waste threads entangled between the leading end portion of the needle thread and the bobbin thread. Consequently, enhanced stitching quality is attainable.

In the sewing machine provided with the thread cutting mechanism, since the thread tension releasing mechanism and thread releasing control means are provided, the needle thread tension is released at the thread tension regulating mechanism for a predetermined period immediately after the start of the sewing operation so as to avoid thread disengagement from the eye of the needle, and to direct the leading end portion of the needle thread to the back side of the workpiece as well as to maintain the length of the leading end portion from the eye of the needle to the exactly cutting point of the thread. Thus, minimized length of the leading end portion of the needle thread is provided on the back side of the workpiece by using the thread cutting mechanism which can provide the minimized length of the leading end portion, to thereby obviate disadvantageous thread entanglement between the leading end portion and the bobbin thread. at the initial start-up period of the sewing operation.

Further, in one embodiment of the invention, the thread leading end portion holding mechanism, the drive mechanism for driving the holding mechanism, the control means for controlling the driving means and the needle thread release controlling means are provided. Therefore, during the first predetermined period (t2) immediately after the start of the sewing operation, the needle thread tension is released by the actuation of the thread tension release solenoid, so that disadvantageous tension due to the vertical reciprocating movement of the thread take-up lever is not applied to the needle thread during this period. Accordingly, the leading end portion of the needle thread is not pulledly disengaged from the thread leading end holding mechanism. Further, until the second predetermined period (t3) is elapsed, that is, until after the formation of the knot between the needle thread and the bobbin thread in accordance with the initial stitching, the thread leading end holding mechanism can hold the leading end portion of the needle thread, and therefore, any skip stitching or disengagement of the needle thread from the eye of the needle can be obviated.

Here, since the thread holding mechanism can hold the leading end portion of the thread at a position closely beside the needle positioned at its uppermost position, the needle thread can be cut by the thread cutting mechanism in such a manner that a length of the leading end portion thereof extending between the eye of the needle and the exact cutting point can be reduced or minimized. Hence, in the second stitching operation, the leading end portion can be directed toward the back side of the workpiece, and disadvantageous entanglement of the bobbin thread with the leading end portion is also avoidable, and furthermore, thread pinching work can be eliminated. Consequently, high quality stitching can be provided also in this respect.

While the invention has been described in detail and with reference to specific embodiment thereof, it would be apparent to those skilled in the art that various changes and modifications may be made therein without departing from the spirit and scope of the invention.

What is claimed is:

1. A sewing machine including a sewing machine motor, a bed portion, a throat plate mounted on the bed portion and formed with a needle hole, a sewing needle driven by the sewing machine motor to be reciprocatable through the needle hole in a vertical direction, a thread take-up lever driven in synchronism with the vertically reciprocating movement of the sewing needle, a loop taker positioned below the throat plate for engaging a needle thread and a bobbin thread with each other in cooperation with the sewing needle, a thread cutting mechanism for cutting the needle thread and the bobbin thread at a position between the throat plate and the loop taker, a thread tension regulating mechanism for applying a resistive force to the needle thread positioned between a thread supplying means and the thread take-up lever, and a thread tension release mechanism for releasing the resistive force from the needle thread, and the improvement comprising;

means (123) for generating a sewing machine motor energization signal;

control means (C) for actuating the thread tension release mechanism (2) for a first predetermined period (t2) in response to the sewing machine motor energization signal in order to release a tension applied to the needle thread (Ns) at the thread tension regulating mechanism (1) at an initial start-up period of a sewing operation.

2. The sewing machine as claimed in claim 1, wherein the loop taker (32) comprises a loop trapping means for trapping a needle thread loop provided after the sewing needle (24) moves from its uppermost position to its lowermost position and then moves upwardly from its lowermost position, the needle thread loop being trapped in the first predetermined period (t2).

3. The sewing machine as claimed in claim 2, further comprising a timer (M2) which provides the first predetermined period (t2) starting from the energization of the sewing machine motor.

4. The sewing machine as claimed in claim 2, further comprising a needle position detector (125) for detecting a position of the sewing needle and for generating a needle position signal containing a lower needle position pulse signal, the first predetermined period being started at a timing of the generation of the sewing machine motor energization signal and ending at a falling edge of a first lower needle position pulse signal after the energization of the sewing machine motor.

5. The sewing machine as claimed in claim 1, further comprising:

a holding mechanism (51) for holding a leading end portion of the needle thread, the holding mechanism comprising: a thread holding member (100) provided movable to a thread trapping position at a position immediately below the sewing needle (24) positioned at its uppermost position, a thread holdable position at a position closely beside the sewing needle positioned at its uppermost position, and a thread releasable position for releasing the trapped and held needle thread; and a holding force imparting member (97) engageable with the thread holding member when the thread holding member is at its thread holdable position for holding the leading end portion of the needle thread between the thread holding member (100) and the holding force imparting member (97);

drive means (52) connected to the thread holding member (100) for selectively moving the thread holding member to one of its thread trapping position, thread holdable position and thread releasable position; and means (C) for controlling the drive means (52) for moving the thread holding member (100) from its thread releasable position to its thread holdable position by way of its thread trapping position after the thread cutting operation by the thread cutting mechanism is completed and for controlling the drive means (52) for moving the thread holding member (100) to its thread releasable position after elapse of a second predetermined period (t3) and in response to the sewing machine motor energization signal.

6. The sewing machine as claimed in claim 5, wherein a knot between the needle thread and the bobbin thread is formed during the second predetermined period (t3).

7. The sewing machine as claimed in claim 5, wherein the first predetermined period is within the second predetermined period.

8. A method for minimizing a length of a leading end portion of a needle thread in a sewing machine which includes a sewing machine motor, a bed portion, a throat plate mounted on the bed portion and formed with a needle hole, a sewing needle driven by the sewing machine motor to be reciprocatable through the needle hole in a vertical direction, a thread take-up lever driven in synchronism with the vertically reciprocating movement of the sewing needle, a loop taker positioned below the throat plate for engaging a needle thread and a bobbin thread with each other in cooperation with the sewing needle, a thread cutting mechanism for cutting the needle thread and the bobbin thread at a position between the throat plate and the loop taker, a thread tension regulating mechanism for applying a resistive force to the needle thread positioned between a thread supplying means and the thread take-up lever, and a thread tension release mechanism for releasing the resistive force from the needle thread, and the method comprising the steps of;

generating a sewing machine motor energization signal; and actuating the thread tension release mechanism (2) for a first predetermined period (t2) in response to the sewing machine motor energization signal in order to release a tension applied to the needle thread (Ns) at the thread tension regulating mechanism (1) at an initial start-up period of a sewing operation.

9. The method as claimed in claim 8, wherein a needle thread loop is provided after the sewing needle (24) moves from its uppermost position to its lowermost position and then moves upwardly from its lowermost position in the first predetermined period (t2), the thread loop being trapped by the loop taker in the first predetermined period.

10. The method as claimed in claim 9, wherein the sewing machine further includes a holding mechanism (51) for holding a leading end portion of the needle thread, the holding mechanism comprising: a thread holding member (100) provided movable to a thread trapping position at a position immediately below the sewing needle (24) positioned at its uppermost position, a thread holdable position at a position closely beside the sewing needle positioned at its uppermost position, and a thread releasable position for releasing the trapped and held needle thread; and a holding force imparting member (97) engageable with the thread holding member when the thread holding member is at its thread holdable position for holding the leading end portion of the needle thread between the thread holding member (100) and the holding force imparting member (97); drive means (52) connected to the thread holding member (100) for selectively moving the thread holding member to one of its thread trapping position, thread holdable position and thread releasable position; and wherein the method further comprising the steps of operating the drive means (52) for moving the thread holding member (100) from its thread releasable position to its thread holdable position by way of its thread trapping position after the thread cutting operation by the thread cutting mechanism is completed, and operating the drive means (52) for moving the thread holding member (100) to its thread releasable position after elapse of a second predetermined period (t3) and in response to the sewing machine motor energization signal.

11. The method as claimed in claim 10, wherein the sewing needle is moved downwardly from its uppermost position and a knot between the needle thread and the bobbin thread is formed during the second predetermined period (t3).

12. The sewing machine as claimed in claim 11, wherein the first predetermined period is within the second predetermined period.

* * * * *